US011613335B2

(12) United States Patent
Damay et al.

(10) Patent No.: US 11,613,335 B2
(45) Date of Patent: Mar. 28, 2023

(54) CYCLOIDAL DYNAMIC PROPULSION OR POSITIONING SYSTEM FOR A SHIP

(71) Applicant: ECOLE NATIONALE SUPERIEURE D'ARTS ET METIERS, Paris (FR)

(72) Inventors: Thomas Damay, Crozon (FR); Frédéric Hauville, Crozon (FR); Jacques-André Astolfi, Crozon (FR)

(73) Assignee: ECOLE NATIONALE SUPERIEURE D'ARTS ET METIERS, Paris (FR)

( * ) Notice: Subject to any disclaimer, the term of this patent is extended or adjusted under 35 U.S.C. 154(b) by 12 days.

(21) Appl. No.: 17/414,894

(22) PCT Filed: Dec. 13, 2019

(86) PCT No.: PCT/EP2019/085163
§ 371 (c)(1),
(2) Date: Jun. 16, 2021

(87) PCT Pub. No.: WO2020/126933
PCT Pub. Date: Jun. 25, 2020

(65) Prior Publication Data

US 2022/0063783 A1 Mar. 3, 2022

(30) Foreign Application Priority Data

Dec. 19, 2018 (FR) ..... 1873269

(51) Int. Cl.
*B63H 1/10* (2006.01)

(52) U.S. Cl.
CPC ..... *B63H 1/10* (2013.01); *B63H 2001/105* (2013.01)

(58) Field of Classification Search
CPC ..... B63H 1/10; B63H 2001/105
See application file for complete search history.

(56) References Cited

U.S. PATENT DOCUMENTS 2,971,583 A 2/1961 Hansen et al.
2015/0147176 A1* 5/2015 Curutchet ..... F03D 3/005 416/41
2015/0321740 A1* 11/2015 Bradley ..... B63H 3/002 416/1

FOREIGN PATENT DOCUMENTS

CN 102458979 A * 5/2012 ..... B63H 3/10
DE 20117451 U1 2/2002
(Continued)

OTHER PUBLICATIONS

Feb. 10, 2020 International Search Report issued in International Patent Application No. PCT/EP2019/085163.

*Primary Examiner* — Andrew Polay
(74) *Attorney, Agent, or Firm* — Oliff PLC

(57) ABSTRACT

A cycloidal dynamic propulsion or positioning system for a ship in water that exhibits a direction of flow, including a frame, a rotor mounted to be movable in rotation on the frame about a main axis at right angles to the flow, including a plurality of arms extending radially with respect to the main axis, a main motor equipped with a rotary coder and driving the rotor in rotation, for each arm, a blade mounted to be movable in rotation on the arm about a secondary axis parallel to the main, for each blade, a secondary motor equipped with a rotary coder and driving the blade in rotation, for at least one blade, a load sensor able to evaluate the loads exerted on the blade, and a control unit connected to each coder, strain sensor and motor and controlling the rotation of each motor in terms of angle and speed.

6 Claims, 1 Drawing Sheet

(56) References Cited

FOREIGN PATENT DOCUMENTS

| | | | |
|---|---|---|---|
| EP | 1835173 | A2 | 9/2007 |
| WO | 9745319 | A1 | 12/1997 |

* cited by examiner

[Fig. 1]
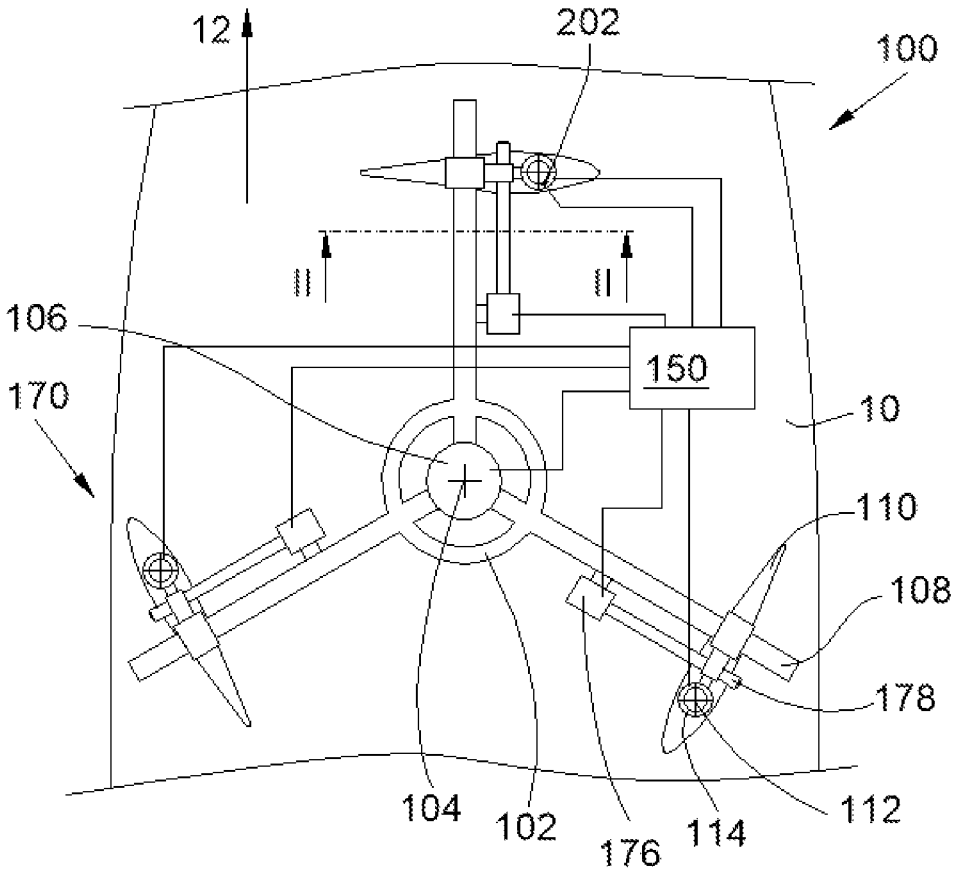
[Fig. 2]
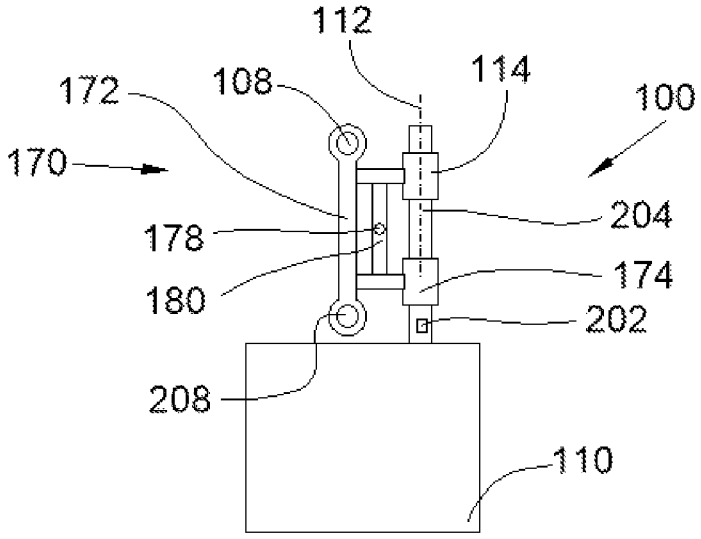

CYCLOIDAL DYNAMIC PROPULSION OR POSITIONING SYSTEM FOR A SHIP

TECHNICAL FIELD

The present invention relates to a cycloidal dynamic propulsion or positioning system for a ship, and a ship comprising at least one such cycloidal dynamic propulsion or positioning system.

STATE OF THE ART

A propulsion system of Voith-Schneider type is disposed under the hull of a ship, and it comprises a rotor with vertical axis which is driven in rotation about a main axis by a motor, and a plurality of vertical blades in which each is mounted to be movable on the rotor at a distance from the main axis.

Each blade is movable in rotation about a secondary axis, also vertical.

The propulsion system also comprises a mechanical system, generally consisting of connecting rods, which is configured to displace each blade as a function of the degree of rotation of the rotor. The displacement of each blade is cyclic and, based on the position of the rotor, each blade takes a particular position that it returns to on each revolution.

Also known is the document US-A-2015/321740 which discloses a propulsion system with vertical blades and a control unit which controls the propulsion system using different position sensors which are linked to the blades, However, none of these sensors is a load sensor which informs on the loads undergone by at least one blade.

Although such a propulsion system gives satisfactory results, it is desirable to find a propulsion system which allows a greater freedom in the position of the blades.

SUMMARY OF THE INVENTION

One object of the present invention is to propose a cycloidal dynamic propulsion or positioning system which comprises means for displacing the blades independently of one another based on the loads undergone by at least one blade.

To this end, a cycloidal dynamic propulsion or positioning system is proposed for a ship sitting in water that exhibits a direction of flow, said cycloidal dynamic propulsion or positioning system comprising:

- a frame,
- a rotor mounted to be movable in rotation on the frame about a main axis at right angles to the direction of flow, and comprising a plurality of arms extending radially with respect to the main axis,
- a main motor equipped with a rotary coder and driving said rotor in rotation,
- for each arm, a blade mounted to be movable in rotation on the arm about a secondary axis parallel to the main axis,
- for each blade, a secondary motor equipped with a rotary coder and driving said blade in rotation,
- for at least one blade, a load sensor arranged to be able to evaluate the loads which are exerted on the blade, and
- a control unit connected to each rotary coder, to the load sensor and to each motor and controlling the rotation of each motor in terms of both angle and speed.

Such a cycloidal dynamic propulsion or positioning system makes it possible to adjust the position of each blade as a function of the data collected by the load sensor and thus optimize the efficiency of the propulsion system.

Advantageously, the load sensor is disposed on a shaft between the secondary motor and the blade.

Advantageously, the cycloidal dynamic propulsion or positioning system comprises a displacement system controlled by the control unit and intended to displace the blade and the associated secondary motor along the arm.

Advantageously, the main motor operates as an electrical generator.

Advantageously, the displacement system comprises:

- for each arm, an additional arm fixed to the rotor parallel to said arm,
- a runner secured to the secondary motor, and mounted to slide on the arm and the additional arm,
- a drive system which is connected and controlled by the control unit to displace the runner along the arms.

The invention also proposes a ship comprising a hull and a cycloidal dynamic propulsion or positioning system according to one of the preceding variants in which the frame is fixed to the hull and in which at least the blades are outside the hull.

BRIEF DESCRIPTION OF THE DRAWINGS

The features of the invention mentioned above, and others, will become more clearly apparent on reading the following description of an exemplary embodiment, said description being given in relation to the attached drawings, in which:

FIG. 1 is a top view of a cycloidal dynamic propulsion or positioning system according to the invention, and FIG. 2 is a view in cross section along the line II-II of the cycloidal dynamic propulsion or positioning system of FIG. 1.

DETAILED DESCRIPTION OF EMBODIMENTS

In the following description, the terms relating to a position are taken with reference to a propulsion system of the Voith-Schneider type in position of use under the hull of a ship.

FIG. 1 shows a ship represented by a part of its hull 10. The ship sits in water. The ship can be a ship having a direction of advance 12 parallel to the axis of the ship and navigating on the surface or underwater. The ship can also be a ship which seeks to maintain its position in currents, such as a platform for example. In one case as in the other, the ship sits in water which exhibits a direction of flow with respect to the ship which is due to the speed of the ship or to the water current. In the case of a ship with a direction of advance 12, the direction of flow is the reverse of the direction of advance 12.

The ship is equipped, under its hull 10, with a cycloidal dynamic propulsion or positioning system 100 which comprises a frame fixed to the hull 10, a rotor 102 mounted to be movable in rotation on the frame about a main axis 104 which is at right angles to the direction of flow. The main axis 104 is thus transversal with respect to the direction of flow.

Thus, for a ship on the surface, the main axis 104 is vertical or with a small angle with respect to the vertical. For a ship underwater, the main axis 104 can take another orientation in a plane at right angles to the direction of flow. Thus, in the case of an underwater ship, there could be three cycloidal dynamic propulsion or positioning systems 100 angularly distributed at 120° from one another in a plane at right angles to the direction of flow.

FIG. 2 shows a part of the cycloidal dynamic propulsion or positioning system 100. Depending on the case, the cycloidal dynamic propulsion or positioning system 100 makes it possible to advance the ship or to hold it in its position.

The rotor 102 is driven in rotation by a main motor 106 equipped with a rotary coder that makes it possible to know the angular position of the main motor 106.

The rotor 102 is equipped with a plurality of arms 108, here three of them. Each arm extends radially with respect to the main axis 104.

Each arm 108 bears a blade 110 which is mounted to be movable in rotation on the arm 108 about a secondary axis 112 parallel to the main axis 104, that is to say, here, vertical. The secondary axes 112 and the main axis 104 do not coincide, that is to say that each secondary axis 112 is at a distance from the main axis 104. The blades 110 are situated outside of the hull 10, and in particular under the hull 10.

Each blade 110 is driven in rotation by a secondary motor 114 equipped with a rotary coder that makes it possible to know the angular position of the secondary motor 114.

The cycloidal dynamic propulsion or positioning system 100 also comprises a control unit 150 which receives information from the rotary coders and controls the rotation of each motor 106, 114 in terms of both angle and speed.

In order to allow the interaction between the water and the blades 110, at least the blades 110 are outside the hull 10. Depending on the layout of the cycloidal dynamic propulsion or positioning system 100, other elements may be entirely or partially in the water or in a fairing above the water.

The control unit 150 comprises, conventionally linked by a communication bus: a processor or CPU (Central Processing Unit); a random access memory RAM; a read only memory ROM; a storage unit such as a hard disk or a storage medium reader; at least one communication interface, allowing the control unit 150 to communicate with the rotary coders, the motors 106, 114 and at least one load sensor 202 as is explained below.

The processor is capable of executing instructions loaded into the RAM from the ROM, from an external memory (not represented), from a storage medium (such as an SD card), or from a communication network. When the cycloidal dynamic propulsion or positioning system 100 is powered up, the processor is capable of reading instructions from the RAM and of executing them. These instructions form a computer program causing the implementation, by the processor, of all or part of the algorithms and steps described hereinbelow.

All or part of the algorithms and steps described hereinbelow can be implemented in software form by the execution of a set of instructions by a programmable machine, for example a DSP (Digital Signal Processor) or a microcontroller, or be implemented in hardware form by a machine or a dedicated component, for example an FPGA (Field-Programmable Gate Array) or an ASIC (Application-Specific Integrated Circuit).

Thus, the control unit 150 can control the position of each blade 110 independently of one another as a function of the position of the rotor 102 informed by the rotary coder of the main motor 106 and more simply than with the use of a mechanical system. Based on the position of the rotor 102, each blade 110 takes a particular position which therefore varies with the rotation of the rotor 102.

Furthermore, it is possible to switch from epicycloidal operation to trochoidal operation simply and rapidly.

The cycloidal dynamic propulsion or positioning system 100 also comprises, for at least one blade 110, a load sensor 202 connected to the control unit 150. The load sensor 202 is arranged so as to be able to evaluate the loads which are exerted on the blade 110. In the embodiment of the invention presented in FIG. 2, the load sensor 202 is disposed on the shaft 204 in the secondary motor 114 and the blade 110. The shaft 204 is, here, the motor shaft of the secondary motor 114 and the blade 110 is fixed to this shaft 204.

In the present case, the load sensor 202 measures the loads undergone by the shaft 204 which are representative of the loads being exerted on the blade 110 and that the blade 110 therefore undergoes because of the water, in particular the tensile and/or compressive and/or flexural loads undergone by the blade 110.

According to a particular embodiment, the load sensor 202 is a sensor which comprises at least one strain gauge and, according to a particular embodiment, the sensor is based on strain gauges mounted in Wheatstone bridge configuration, that is to say that there are at least four gauges mounted in Wheatstone bridge configuration, but there can be several Wheatstone bridges, i.e. as many times four gauges. Obviously, any other technology can be envisaged, such as a piezo sensor for example.

A load sensor 202 called "balance" is for example used (here, a balance with two components), allowing access to the loads normal and tangential to the blade 110 independently of the point of application of the load.

Internally, this load sensor 202 comprises several strain gauge bridges which measure the displacements (very small, of a few tens of micrometers) due to the hydrodynamic loading, and a specific matrix computation involving these measurements, makes it possible to work out the loads required. A prior calibration of the balance allows the matrix used to be constructed. The calibration is done out of water and it consists in measuring the outputs of the gauge bridges for loads that are known and imposed at different points of the blade 110.

Only a single load sensor 202 need be put in place, because the deformations of each blade 110 are considered to be identical for an angular position of the rotor 102 and an angular position of the blade 110. Obviously, it is possible to have one load sensor 202 for each blade 110.

Thus, from the data recorded by the load sensor 202, the control unit 150 manages the speed of rotation of the rotor 102 and the position of each blade 110 as a function of the angular position of the rotor 102. For example, each blade 110 can be positioned so as to maximize the loads in the direction of advance of the ship.

The pitch of the blades 110 can therefore be adapted according to the speed of rotation of the rotor 102 and as a function of data from the load sensor 202. Thus, the detection of strong load variations on the blade 110 can be the sign of a slippage of the boundary layer around this blade 110, and it is then possible to modify the position of the blades 110 in order to avoid this slippage at each angular position of the rotor 102.

In the embodiment of the invention presented in FIGS. 1 and 2, each blade 110 is movable in translation along the associated arm 108 in order to modify the center distance between the main axis 104 and the secondary axis 112.

This embodiment is particularly advantageous when the main motor 106 can operate as an electrical generator. The change of center distance of the blades 110 makes it possible to extend the center distance and thus, when the water current makes the blades 110 revolve about the main axis 104, the main motor 106 operating as an electrical generator generates an electrical current to deliver electricity to the ship or to storage batteries.

To this end, the cycloidal dynamic propulsion or positioning system 100 comprises, for each blade 110, a displacement system 170 which is a motorized slide system which is controlled by the control unit 150 and arranged to displace the blade 110 and the associated secondary motor 114 along the arm 108.

In the embodiment of the invention presented here, the displacement system 170 comprises, for each arm 108, an additional arm 208 fixed to the rotor 102 parallel to said arm 108 and disposed here under said arm 108.

The displacement system 170 also comprises a runner 172 mounted to slide on the arm 108 and the additional arm 208.

The runner 172 is secured to the secondary motor 114.

In the embodiment of the invention presented in FIG. 2, the runner 172 is also secured to a bearing 174 in which the shaft 204 is mounted.

The displacement system 170 comprises a drive system which is connected and controlled by the control unit 150 to displace the runner 172 along the arms 108 and 208.

The drive system can for example be a cylinder, for example hydraulic.

The drive system here comprises a displacement motor 176 bearing a threaded rod 178 meshing with a nut 180 of the runner 172 so as to form a worm screw system in which the rotation of the threaded rod 178 in one direction will displace the runner 172 and therefore the blade 110 in one direction and in which the rotation of the threaded rod 178 in the opposite direction will displace the runner 172 and therefore the blade 110 in an opposite direction.

The displacement motor 176 is connected and controlled by the control unit 150.

The invention claimed is:

1. A cycloidal dynamic propulsion or positioning system for a ship sitting in water that exhibits a direction of flow, said cycloidal dynamic propulsion or positioning system comprising:

a frame, a rotor mounted to be movable in rotation on the frame about a main axis at right angles to the direction of flow, and comprising a plurality of arms extending radially with respect to the main axis, a main motor equipped with a rotary coder and driving said rotor in rotation, for each arm, a blade mounted to be movable in rotation on the arm about a secondary axis parallel to the main axis, for each blade, a secondary motor equipped with a rotary coder and driving said blade in rotation, for at least one blade, a load sensor arranged to be able to evaluate the loads which are exerted on the blade, and a control unit connected to each rotary coder, to the load sensor and to each motor and controlling the rotation of each motor in terms of both angle and speed.

2. The cycloidal dynamic propulsion or positioning system as claimed in claim 1, wherein the load sensor is disposed on a shaft between the secondary motor and the blade.

3. A ship comprising a hull and a cycloidal dynamic propulsion or positioning system as claimed in claim 1, in which the frame is fixed to the hull and in which at least the blades are outside the hull.

4. A cycloidal dynamic propulsion or positioning system for a ship sitting in water that exhibits a direction of flow, said cycloidal dynamic propulsion or positioning system comprising:

a frame;

a rotor mounted to be movable in rotation on the frame about a main axis at right angles to the direction of flow, and comprising a plurality of arms extending radially with respect to the main axis;

a main motor equipped with a rotary coder and driving said rotor in rotation;

for each arm, a blade mounted to be movable in rotation on the arm about a secondary axis parallel to the main axis;

for each blade, a secondary motor equipped with a rotary coder and driving said blade in rotation;

for at least one blade, a load sensor arranged to be able to evaluate the loads which are exerted on the blade;

a control unit connected to each rotary coder, to the load sensor and to each motor and controlling the rotation of each motor in terms of both angle and speed; and a displacement system controlled by the control unit and intended to displace the blade and the associated secondary motor along the arm.

5. The cycloidal dynamic propulsion or positioning system as claimed in claim 4, wherein the main motor operates as an electrical generator.

6. A cycloidal dynamic propulsion or positioning system for a ship sitting in water that exhibits a direction of flow, said cycloidal dynamic propulsion or positioning system comprising:

a frame;

a rotor mounted to be movable in rotation on the frame about a main axis at right angles to the direction of flow, and comprising a plurality of arms extending radially with respect to the main axis;

a main motor equipped with a rotary coder and driving said rotor in rotation;

for each arm, a blade mounted to be movable in rotation on the arm about a secondary axis parallel to the main axis;

for each blade, a secondary motor equipped with a rotary coder and driving said blade in rotation;

for at least one blade, a load sensor arranged to be able to evaluate the loads which are exerted on the blade;

a control unit connected to each rotary coder, to the load sensor and to each motor and controlling the rotation of each motor in terms of both angle and speed; and a displacement system controlled by the control unit and intended to displace the blade and the associated secondary motor along the arm, wherein the displacement system comprises:

for each arm, an additional arm fixed to the rotor parallel to said arm, a runner secured to the secondary motor, and mounted to slide on the arm and the additional arm, a drive system which is connected and controlled by the control unit to displace the runner along the arms.

* * * * *